United States Patent [19]

Vigander

[11] Patent Number: 5,074,715

[45] Date of Patent: Dec. 24, 1991

[54] OIL STORAGE SYSTEM

[75] Inventor: Kjell Vigander, Jar, Norway

[73] Assignee: Norwegian Contractors A/S, Stabekk, Norway

[21] Appl. No.: 537,870

[22] Filed: Jun. 14, 1990

Related U.S. Application Data

[63] Continuation of Ser. No. 269,537 filed as PCT/NO88/00019 Mar. 4, 1988, published as WO88/06561 Sep. 7, 1988.

[30] Foreign Application Priority Data

Mar. 4, 1987 [NO] Norway ..... 870904

[51] Int. Cl.[5] ..... E02D 27/38

[52] U.S. Cl. ..... 405/210; 114/257

[58] Field of Search ..... 405/59, 210; 114/256, 114/257

[56] References Cited

U.S. PATENT DOCUMENTS

| | | | |
|---|---|---|---|
| 3,961,488 | 6/1976 | Ovsttun | 405/210 |
| 4,200,411 | 4/1980 | Brown et al. | 405/210 |
| 4,230,422 | 10/1980 | Brown et al. | 405/210 |

*Primary Examiner*—Dennis L. Taylor
*Assistant Examiner*—J. Russell McBee

[57] ABSTRACT

An oil storage system for an offshore platform having at least one submerged storage cell in which oil is stored on top of a water volume. In fluid communication with the submerged storage cell is another submerge cell containing water, the water storage cell is in fluid communication with ambient water outside the system.

6 Claims, 1 Drawing Sheet

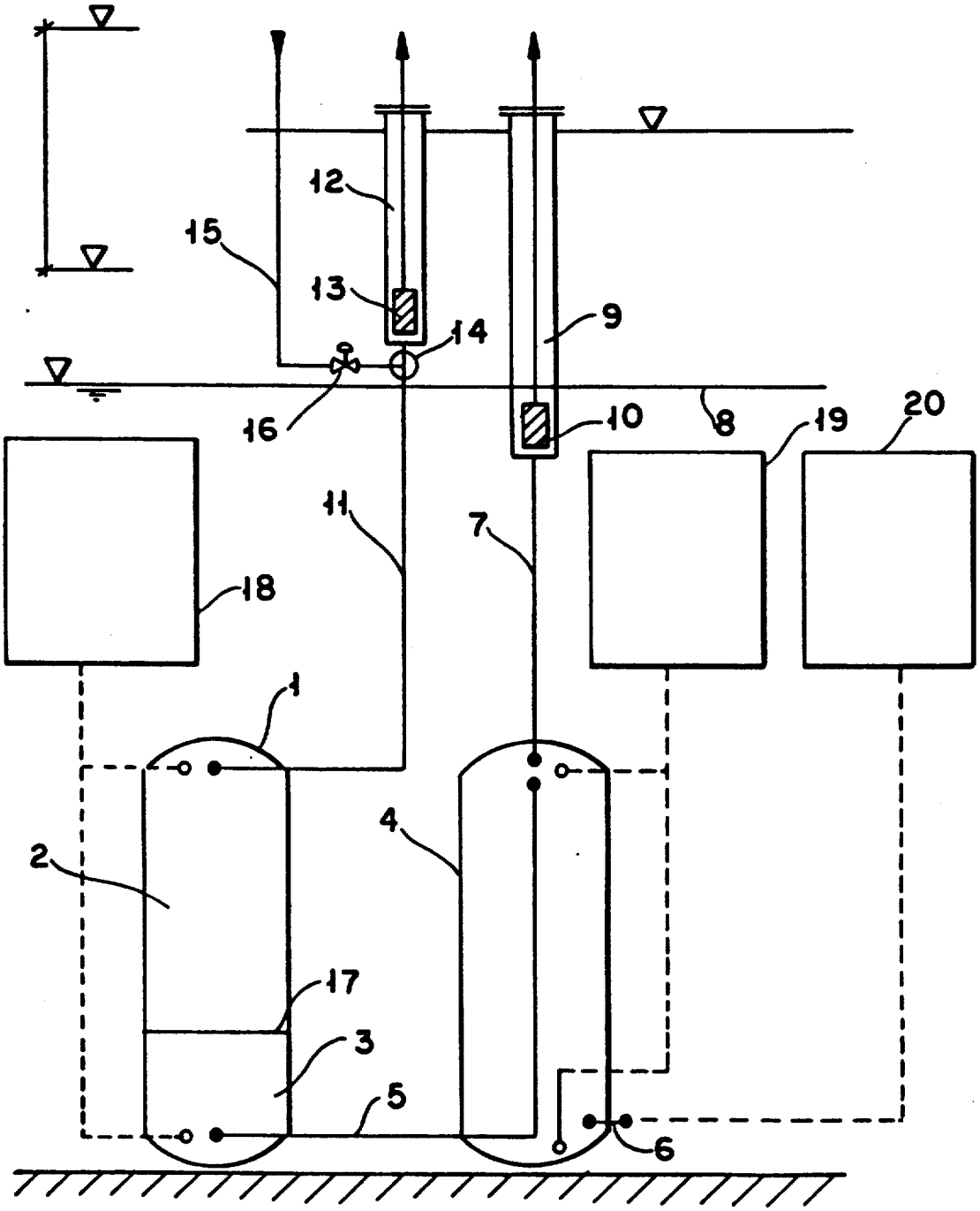
12
15
13
14
9
16
10
8
19
20
11
7
18
1
4
2
17
3
5
6

OIL STORAGE SYSTEM

This is a continuation of copending application Ser. No. 07/269,537 filed on Nov. 9, 1988 and International Application PCT/NO88/00019 filed on Mar. 4, 1988.

BACKGROUND OF THE INVENTION

The present invention relates to a storage system for hydrocarbons on a offshore platform comprising a number of submerged storage cells for hydrocarbons, wherein hydrocarbons are stored on top of a water bed.

SUMMARY OF THE INVENTION

The object of the present invention is to provide a storage system that is reasonably affordable and which prevents against incidental oil leakages to the ambient sea. A further object of the invention is to provide a system whereby the need for permanently installed, movable units is substantially reduced.

In accordance with the present invention these objects are obtained with an oil storage system having a plurality of storage cells for storing hydrocarbons, and which stands in open communication with at least one other cell which practically speaking only contains water, since the said second cell freely communicates with the ambient sea outside the storage system.

There is provided a conveyor or pipe connection between the lowermost part to the uppermost part of the water cells in the oil storage system, simultaneously as the lowermost part of the water cells freely communicates with the ambient sea, for instance by means of a pipe line or an opening in the cell wall.

From the upper end of the water cell a pipe system is connected which extends towards the sea surface. The lowermost part of the pipe is positioned above the the outlet for the communication piping which connects the water cell and oil storage cells. At said uppermost end of the pipe a tank is positioned at the sea surface, from which tank oil may be removed by pumping for instance by means of a submersible pump. The media is pumped through a separate separation unit for complete removal of oil residuals before the water is pumped out into the sea.

The water cell has two principal functions, namely:

- to serve as an oil separation/water rinsing vessel for oil which incidentally has come into this cell through the unobstructed, open communication between the storage cells. Water will pass to and from in dependence upon whether oil is pumped into or out from the oil storage cells. Oil in this water will in such case get sufficient time to float up to the upper part of the water cell and up through the pipe to the tank. It shall in this connection be remarked that the through flowing of water in the water cell will be very slow, such that oil particles may be separated,
- serve as an oil catcher whereby one can secure that oil will not escape out into the sea.

Through the solution in accordance with the present invention is obtained that all equipment having movable elements such as valves, manifolds, pumps and the like can be positioned above the sea surface and thus not be submerged or positioned in dry spaces below the sea surface, such as is known in connection with earlier solutions.

This involves that the pipe system in practice for instance can be cast into the concrete walls of a platform, either directly or into vertical pilasters or the like. Thereby, there is a reduced risk of pipe failures caused by blows or corrosion. The present invention will be especially useful in connection with mono-tower production well platforms where the tower must be filled with water.

The system can also be utilized in connection with an oil storage submerged down at the sea bottom, for instance in conjunction to a fundament for a tension leg platform. In such embodiment the pumps and manifolds would be positioned in the floating structure and connected to the oil storage to separate riser pipes.

BRIEF DESCRIPTION OF THE DRAWINGS

The present invention shall in the following be described further with reference to the attached drawing which schematically shows the principal features of the present invention, somewhat simplified, since only one single oil storage cell is shown for the sake of clarity.

The FIGURE schematically shows a simplified oil storage system in accordance with the invention. The system comprises one oil storage cell 1 designed for storage of oil. As shown the oil storage cell 1 contains oil 2 which floats on top of a water bed 3. The oil storage cell 1 stands in open communication with a water cell 4 through a pipe system 5. The end of the pipe system 5 which is positioned in the oil storage cell 1 is located at the lower end of same and at the lower part of the water bed 3. The water cell 4 is designed for substantially containing water and stands in free communication with the ambient sea via an opening or a pipe 6. This opening 6 is located at the lower end of the water cell 4. From the upper end of the water cell 4 and at a level somewhat above the end of the pipe 5, extends a pipe 7 upwards towardes the deck of the platform. In the vicinity below the ambient water surface 8 the pipe 7 extends over to a tank 9 which has a such size and a such cross-section that a pump 10 can be sent down into the same and/or be permanently installed in said tank 9.

From the upper end of the oil storage cell 1 extends a pipe system 11 which reaches above the sea surface 8 and which is connected to tank 12. The tank 12 has a volume and a cross-section which makes it possible to lower and/or permanently installing a pump 13 for pumping oil from the oil storage cell 1. Several tanks 12 may naturally be coupled together through a manifold 14.

In the FIGURE only one single oil storage cell 1 is shown. It shall, however, be noted that it rests within the frame of the invention to utilize a series of oil storage cells 1 and that the oil/water level in the same at any time can be different from each other. For this purpose the manifold 14 is equipped with valves for one each of the oil storage cells 1. Likewise the manifold can be controlled with valves if oil shall be pumped into or out from one of the cells 1.

If the system is for instance used in connection with a Condeep platform, having a caisson with twentyfour cells and four towers, for instance nineteen cells may be oil storage cells 1, while one may be a water cell 4. Lines 7, 11 can extend up into one or more of the towers on the platform.

The oil storage system in accordance with the invention is further equipped with instrument enabling measurement of the level for the dividing plane or separation plane between oil 2 and water 3 in the oil storage cell 1. This system 18 indicates stored oil at any time enabling control in regard loading/deloading storage.

In the water cell 4 is further provided an alarm system 19 which shall be further described in detail in the following. It is in addition possible, by sampling system 20, to take water samples at the opening 6 in connection with the escape of water from the storage.

Since the water cell 4 for all practical purposes will be filled with water, it will not exist any substantial pressure difference in the water inside the tank 9 and the outside located sea level. It will further be relatively constant. The difference in level between the sea surface outside and the liquid level in the tank 12 will, however, vary in dependence of the volume of the oil 2 in the oil storage cells relative to the water volume 3, because water is heavier than oil.

If oil is pumped out of the oil storage cells 1 via the tank 12, water will be drawn into the water cell 4 via the opening 6 and the pipe line 5, whereby the dividing or border plane between oil and water designated with the number 17, will move upwards. If on the contrary oil is transferred to the oil storage cell 1 via the line 15,11, water will be pressed out of the oil storage cell 1 in opposite direction. By such pumping of oil into the cell, water mixed with oil will be pressed through the line 5 into the water cell 4. In this cell the water will, however, remain for a sufficiently long time such that the oil particles can separate from the water and ascend upwards into the water cell to accummulate in the dome and be pumped upwards through pipe 7. Oil can in this fashion be removed from the water cell 4 through the tank 9.

In order to operate the system in a safe manner and without causing oil contamination or pollution, one needs a control- and alarm system in the oil storage cells 1. This system indicates the level for the dividing plane 17 between oil and water and will give the operator of the system an alarm if too high or too low water level 17 occurs in the oil storage cell 1. Such measuring meters shall be present in all storage cells, and may consist of conventional pressure gauges.

Also in the water cell 4 are located instruments 19 which measure a possible dividing plane between oil and water. Such an alarm system has two objectives, namely:

to give alarm when water enters the water cell 4, and to stop further supply of water into the storage cells 1, if the oil penetration supersedes a certain quantity.

With this system will therefore firstly receive a warning from the oil storage cells 1, and thereafter a warning from the water cell 4 if the first warning has not been followed by some action. Alternatively the system can automatically stop further supply of oil into the oil storage cells 1.

Oil which possibly has come into the tank 9 can suitably be pumped over into one of the oil storage cells 1 or to a treatment tank by means of the pump 10. If the water cell 4 is partly filled with oil, the same will flow back into the oil storage cells 1 by means of the pump 13.

As a measure of safety one may let the pump 10 operate between certain intervals and control whether oil has reached the tank 9. This will increase the safety.

The system 7, 9 including the pump 10, may be so dimensioned that the pump 10 has somewhat greater capacity than the oil production volume. Thereby the pump 10 will remove the production volume and also supply some extra water through the opening 6. Through this solution no water will escape from the oil storage, but has to be rinsed in a known manner.

This system 7 and 9 in accordance with the invention can also be utilized for injecting chemicals in controlled fashion into the storage cells 1, for instance in order to combat acid water or the like.

I claim:

1. An oil storage system for an offshore platform comprising at least one submerged oil storage cell wherein the oil is stored on top of a water volume, said oil storage cell is in fluid communication with at least one water storage cell in fluid communication with the ambient water outside the system so that said water storage cell is maintained at the ambient water pressure, said oil storage cell and said water storage cell are in fluid communication with at least one oil storage tank positioned above said water and oil cells.

2. An oil storage system for an offshore platform comprising at least one submerged oil storage cell for storing oil on top of a water volume, said oil storage cell provided with conduit means connected to means positioned above sea level for supplying and discharging oil from the oil storage cell, said oil storage cell being in communication with at least one water storage cell, said oil storage cell and water storage cell are in fluid communication through first piping means connected between a lower portion of said oil storage cell and an upper portion of said water storage cell, and wherein a lower portion of said water storage cell is in open fluid communication with the ambient water outside the system so that said water storage cell is maintained at the ambient water pressure, and wherein a second piping means extends upwards from said water storage cell towards sea level and which has a lower end located in said water storage cell which is positioned above a first end of said first piping means located in said water storage cell.

3. The oil storage system according to claim 2, wherein said means for supplying and discharging from the oil storage cell includes at least one first storage tank.

4. The oil storage system according to claim 3, wherein a first pump means is in fluid communication with said first storage tank and said oil storage cell to pump oil contained in said oil storage cell into said first storage tank.

5. An oil storage system in accordance with claim 4, wherein an upper end of said second piping means is in fluid communication with at least one second storage tank so that a second pump means in fluid communication with said second storage tank can pump oil contained in said water storage cell into said second storage tank.

6. An oil storage system in accordance with claim 5, wherein a separation unit in fluid communication with said second storage tank separates any water pumped with the oil.

* * * * *